United States Patent [19]

Rifat

[11] 4,284,099

[45] Aug. 18, 1981

[54] FROST-PROOF FIRE HYDRANT

[76] Inventor: Sultan A. Rifat, 159 Gelston Ave., Brooklyn, N.Y. 11209

[21] Appl. No.: 34,344

[22] Filed: Apr. 30, 1979

[51] Int. Cl.[3] ..... E03B 9/02; F16K 35/02

[52] U.S. Cl. ..... 137/296; 251/96; 251/113

[58] Field of Search ..... 137/272, 294, 296; 251/89, 111, 113, 114, 115, 116, 95, 96

[56] References Cited

U.S. PATENT DOCUMENTS

| | | | |
|---|---|---|---|
| 618,631 | 1/1899 | Winters | 251/96 |
| 633,228 | 9/1899 | Cholodowsky | 251/113 |
| 832,178 | 10/1906 | Weinland | 251/89 X |
| 1,500,587 | 7/1924 | Larson | 251/116 |
| 2,512,320 | 6/1950 | Fischer | 251/95 |
| 3,532,108 | 10/1970 | Sullivan | 137/296 |
| 3,532,109 | 10/1970 | Smith | 137/296 |

FOREIGN PATENT DOCUMENTS

| | | |
|---|---|---|
| 460059 | 1/1937 | United Kingdom . |
| 1523101 | 8/1978 | United Kingdom . |

*Primary Examiner*—Martin P. Schwadron
*Assistant Examiner*—G. L. Walton
*Attorney, Agent, or Firm*—Hubbell, Cohen, Stiefel & Gross

[57] ABSTRACT

A frost-proof fire hydrant of the type wherein the valve is biased to its closed position by the fluid pressure in the shoe. The fire hydrant includes improved means disposed in the bonnet and cooperating with the valve stem for maintaining the valve in the closed position in the event of decreased water pressure in the shoe.

4 Claims, 2 Drawing Figures

FROST-PROOF FIRE HYDRANT

BACKGROUND OF THE INVENTION

1. Field of the Invention

This invention relates generally to fire hydrants, and more particularly to improvements in fire hydrants of the frostproof type.

2. Statement of the Prior Art

Fire hydrants of the type including a valve stem and a connected valve supported for reciprocating movement in a vertical barrel are, of course, well known. Typically, such hydrants include a bonnet secured to the barrel, the bonnet having an internally threaded aperture which receives the externally threaded upper end of the valve stem. In such hydrants, the valve stem is reciprocated by rotating the valve stem relative to the bonnet. Generally, the valve stem is rotated by a wrench or the like which fits about a suitably shaped projection at the top of the valve stem which protrudes through the bonnet. Fire hydrants fitting this general description may be found in sales brochures distributed by Waterous, South St. Paul, Minnesota; Kennedy Valve Manufacturing Co., Inc., Elmira, New York; United States Pipe and Foundry Company, Smith Valve and Hydrant Division, East Orange, New Jersey; and Clow Corporation, Eddy-Iowa Division, Oskaloosa, Iowa.

The desirability of relying on the water pressure in the shoe connecting the barrel to the water supply line to bias the valve to the closed position to prevent flooding in the event of traffic damage has also been recognized. Hydrants operating according to this principle are also disclosed in the above-mentioned literature.

Still others have recognized that the accumulation of water and subsequent freezing thereof between the mating threads of the bonnet and the valve stem can block reciprocating movement of the stem to open the valve. Based on this, fire hydrants using means other than mating threaded members to accomplish reciprocating movement of the valve stem and connected valve have been suggested. See, for example, U.S. Pat. Nos. 3,532,108 and 3,532,109, wherein the valve stem is reciprocated by a detachable mechanism securable to the bonnet for engagement with the top of the valve stem protruding therethrough. In both patents, the hydrant disclosed is of the type wherein the valve is biased to the closed position by the water pressure in the shoe.

Because of the absence of a threaded connection between the valve stem and the bonnet, the hydrants disclosed in these patents include coil springs for holding the valve stem in the closed position in the event of reduced water pressure or vacuum in the shoe. In U.S. Pat. No. 3,532,108, one end of the coil spring is seated on the bottom of the shoe and the other end is secured about a projection on the bottom of the valve. In U.S. Pat. No. 3,532,109 the coil spring is disposed about the valve stem and has one end seated on a shoulder in the bonnet and the other end seated on a flange on the stem. In arrangements of this type, it is apparent that the coil spring is compressed each time the hydrant is operated to reciprocate the valve stem. Thus, after a period of time, these springs lose their elasticity and may even break. Moreover, the spring may be difficult to replace when it is located in the valve shoe as disclosed in U.S. Pat. No. 3,532,108.

SUMMARY OF THE INVENTION

According to the invention, I have developed an improved fire hydrant of the type wherein the valve is normally biased to the closed position by the water pressure in the shoe and the valve stem is reciprocated in the barrel by means other than mating threads. The improvement comprises an improved mechanism for holding the valve in the closed position in the event the water pressure in the shoe is insufficient to bias the valve to the closed position. The preferred holding means comprises a pin secured to the bonnet for movement between a first position wherein the pin is received in a notch in the valve stem for holding the valve in the closed position and a second position wherein the pin is out of the notch and the valve stem and connected valve are freed for reciprocating movement in the barrel. The pin is preferably movable by a lever secured to the pin and extending through the bonnet. More preferably, the mechanism includes means, such as a spring, for biasing the pin to the first position. To render the hydrant substantially tamper-proof, the hydrant preferably includes detachable means for reciprocating the valve stem in the barrel when the pin is in the second position.

Further features and advantages of the hydrant according to the present invention will be more fully apparent from the following detailed description and annexed drawings of the preferred embodiment thereof.

DETAILED DESCRIPTION OF THE PREFERRED EMBODIMENT

Figure 1:
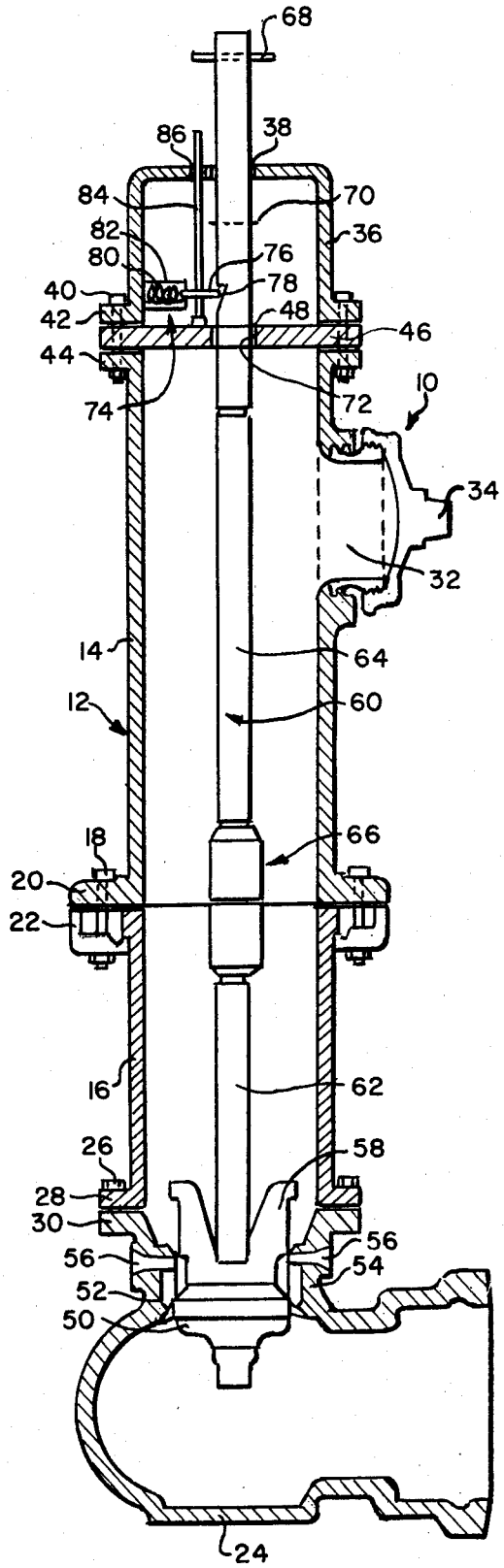
FIG. 1 is an elevational view, partly in section, of the improved hydrant according to the present invention.
Figure 2:
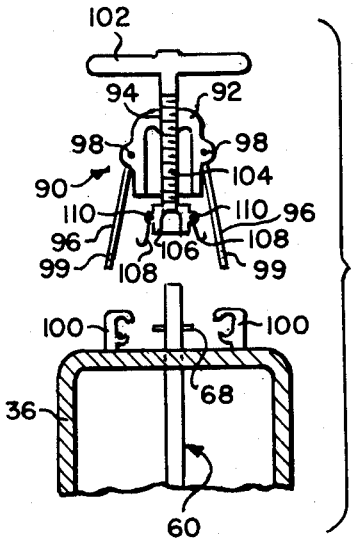
FIG. 2 is a fragmentary elevational view, also partly in section, showing a preferred detachable reciprocating means.

Referring now to the drawings, the preferred fire hydrant in accordance with the present invention is generally designated at 10. Hydrant 10 includes a barrel 12 formed as upper and lower sections 14 and 16, respectively, connected by frangible bolt means 18 extending through confronting flanges 20 and 22 at the ground line. The lower barrel section 16 is connected at its lower end to a hydrant shoe 24 as by bolt means 26 extending through confronting flanges 28 and 30. As is usual, upper barrel section 14 includes one or more nozzles 32 covered by nozzle caps 34 which are removed when the hydrant 10 is in use. A bonnet 36 having a preferably centered axial thru hole 38 is secured to the upper barrel section 14 as by bolt means 40 extending through confronting flanges 42 and 44 on the bonnet and upper barrel section, respectively. As presently preferred and shown, a base plate 46 having a hole 48 aligned with hole 38 in bonnet 36 is disposed between flanges 42 and 44 and secured thereto by the bolt means 40.

Hydrant 10 also includes a valve 50 which seats in its closed position in a valve seat 52 in the upper section 54 of the shoe 24. As shown, the valve 50 is normally held in its closed position by the water pressure in the shoe 24. Upper shoe section 54 is preferably provided with one or more drains 56. In accordance with conventional practice, drains 56 communicate with the chamber defined by barrel 12 when the valve 50 is in its closed position and are sealed by the outer defining wall of the upper section 58 of the valve 50 when the valve 50 is opened. A valve stem 60 extending through barrel 12 and bonnet 36 is connected at one end to the valve 50 and protrudes at its other end through hole 38. The stem 60 is preferably formed in two sections, a lower section 62 and an upper section 64 joined by a frangible coupling 66 at the juncture of barrel sections 14 and 16. Frangible bolt means 18 and frangible coupling 66 avoid damage to the lower sections of the hydrant and possible flooding in the event of damage to hydrant 10 above the ground line. Valve stem 60 also preferably includes a handlebar 68 at its upper end and a travel stop 70 on the portion of the valve stem extending through the bonnet 36. To prevent water in the barrel 12 from entering the bonnet 36, a seal 72 is preferably disposed in the hole 48 about the stem 60.

According to the invention, hydrant 10 includes means 74 for holding valve 50 in its closed position in the event the water pressure in the shoe 24 is insufficient for this purpose. Preferred means 74 includes a pin 76 having one end aligned with an angular notch 78 in the valve stem 60 when the valve 50 is in its closed position. The other end of the pin 76 is connected to means, such as the coil spring 80, for biasing the pin 76 towards the stem 60. Spring 80 is preferably seated in a housing 82 secured to the side wall of the bonnet 36. As presently preferred and shown, the pin 76 is movable out of the notch 70 against the bias of the coil spring 80 by a lever 84. The lever 84 preferably extends through a hole in the pin provided for this purpose. As shown, the upper end of the lever 84 extends through an aperture 86 in the bonnet 36 and the lower end of the lever is pivotally secured to the base plate 46.

As will now be evident, when the valve 50 is in its closed position and the pin 76 is urged into notch 78 by coil spring 80, pin 76 will hold valve stem 60 and connected valve 50 against downward movement even if the water pressure in the shoe 24 is not sufficient for this purpose. To open the valve 50, the lever 84 is pulled to the left in FIG. 1 thereby retracting pin 76 from notch 78. Valve stem 60 and connected valve 50 may then be moved downwards thereby moving the valve 50 to its opened position. As soon as the notch 78 is below the pin 76, the lever 84 may be released whereupon the pin 76 will slide along the stem 60. Downward movement of the stem 60 is limited by travel stop 70 which abuts plate 48 when the valve 50 is in its fully opened position. To avoid interference between pin 76 and stop 70, stop 70 preferably has a radially extending slot (not shown) in alignment with the pin 76. It will thus be apparent that the means 74 is reliable for holding the stem 60 and connected valve 50 in the closed position. Also, because the coil spring 80 is subjected to only slight compression upon downward movement of valve stem 60, spring 80 is not likely to lose its elasticity or break, even after prolonged use. To insure reliability of the means 74, pin 76 and lever 84 are preferably comprised of a material of suitable strength, such as a metal or metal alloy.

While it will be apparent that numerous means may be utilized for reciprocating valve stem 60 and connected valve 50, the means 90 is presently preferred. The preferred means 90 includes a generally cylindrical body 92 open at one end, the body 92 having a threaded thru aperture 94 and a pair of ears 98. As shown, a pair of arms 96 are pivotally secured at one end to the ears 98. The free ends of the arms 96 are provided with apertures 99 which are dimensioned to receive hooks 100 on the top of bonnet 36. Means 90 also includes a handwheel 102 having a threaded stem 104 which extends through and mates with the corresponding threads in the aperture 94. As shown, a cap 106 is connected to the lower end of the stem 104 and a pair of hooks 108 dimensioned for mating with the handlebar 68 are pivotably secured to ears 110 on the cap.

To open valve 50, means 90 is disposed on bonnet 36 such that the upper end of the valve stem 60 is received in the cap 106 and the arms 96 and hooks 108 mate with hooks 100, and handlebar 68, respectively. It will now be evident that rotation of handwheel 102 will force valve stem 60 and connected valve 50 downwards. The valve 50 may be returned to its closed position by rotating the handwheel 102 in the opposite direction until pin 76 snaps into notch 78 when valve 50 is in its closed position. Inasmuch as the water pressure in the shoe will normally be sufficient to prevent an unauthorized user from pushing the stem 60 downwards without the aid of the means 90, the hydrant 10 according to the present invention is substantially tamper-proof. Even if someone were to operate lever 84 to pull pin 76 out of notch 78 and then push valve stem 60 and connected valve 50 downwards during a period of reduced water pressure in the shoe 24, the valve 50 would quickly be returned to its closed position as soon as the water pressure returned to normal.

Having now described the preferred embodiment of a hydrant according to the present invention, those skilled in the art will appreciate that various changes and modifications may be made without departing from the spirit and scope of the invention. Accordingly, the above description should be construed as illustrative and not in a limiting sense, the scope of the invention being defined by the following claims:

I claim:

1. In a fire hydrant including a vertical barrel defining a passage adapted for connection to a shoe; a bonnet having a thru aperture secured to the upper end of the barrel; a valve stem disposed in said barrel for reciprocating movement in said passage with one end of said stem extending through said aperture; valve means connected to the other end of said stem for reciprocating movement therewith between an open position wherein said shoe communicates with said passage and a closed position wherein communication between said shoe and said passage is blocked, said valve means being arranged for movement to said open position against the fluid pressure in said shoe upon downward movement of said stem; and operating means secured to said bonnet and engageable with said one end of said stem for moving said stem and attached valve means to said open position, the improvement which comprises:

a pin moveably secured in said bonnet;

said stem having a hole for receiving said pin, said pin being moveable between a first position wherein said pin is in said hole when said valve is in said closed position and a second position wherein said pin is out of said hole;

a lever secured to said pin and having one end extending through an additional aperture in said bonnet for moving said pin between said first and second positions; and means for biasing said pin to said first position.

2. The fire hydrant according to claim 1, wherein said biasing means comprises a spring secured at one end to said pin and at the other end to said bonnet.

3. The fire hydrant according to claims 1 or 2, and further comprising a plate disposed between said bonnet and said barrel substantially perpendicular to said stem, and wherein the other end of said lever is pivotally secured to said plate.

4. The fire hydrant according to claim 4, wherein said hole comprises a notch having an upper defining surface substantially perpendicular to the axis of the said stem.

* * * * *